United States Patent [19]

Cooper et al.

[11] Patent Number: 4,722,757

[45] Date of Patent: Feb. 2, 1988

[54] SOLID EXPLOSIVE COMPOSITION

[75] Inventors: John Cooper, Alloway, Scotland; Colin A. Mumme-Young, Tarvin; David S. Reid, Kilwinning, both of England

[73] Assignee: Imperial Chemical Industries, London, England

[21] Appl. No.: 24,146

[22] Filed: Mar. 10, 1987

[30] Foreign Application Priority Data

Mar. 14, 1986 [GB] United Kingdom ..... 8606387

[51] Int. Cl.[4] ..... C06B 45/00

[52] U.S. Cl. ..... 149/2; 149/21; 149/36; 149/47; 149/55; 149/56; 149/61; 149/62; 149/69; 149/70; 149/75; 149/76; 149/77; 149/83; 149/85; 149/88; 149/92; 149/105; 149/45

[58] Field of Search ..... 149/2, 21, 36, 47, 55, 149/56, 61, 62, 69, 70, 75, 76, 77, 83, 85, 88, 92, 105, 45

[56] References Cited

U.S. PATENT DOCUMENTS 4,525,225 6/1985 Cechanski ..... 149/85
4,600,450 7/1986 Jessop et al. ..... 149/85
4,600,451 7/1986 Jessop et al. ..... 149/85
4,600,452 7/1986 Jessop et al. ..... 149/85
4,632,714 12/1986 Abegg et al. ..... 149/88

*Primary Examiner*—Stephen J. Lechert, Jr.
*Attorney, Agent, or Firm*—Cushman, Darby & Cushman

[57] ABSTRACT

This invention provides a solid explosive composition comprising a low-water content melt-in-fuel emulsion when prepared at elevated temperature which solidifies on cooling. The emulsion comprises a continuous phase containing water immiscible fuel and emulsifier and a discontinuous phase containing oxidizer salt. A particulate material effective as a nucleating agent is incorporated in the composition to reduce supercooling of the discontinuous phase and to accelerate crystallization of the oxidizer salt.

The particulate nucleating agent is preferably colloidal solid particles for example silica or an insoluble salt of aluminium, calcium or barium, which salt may optionally be formed in situ by a double decomposition reaction.

The presence of the nucleating agent to accelerate crystallization of the oxidizer enhances the proportion of discrete droplets which remain totally encapsulated in the solidified composition and enables solid products to be obtained from relatively low melting oxidizer salts melts.

15 Claims, No Drawings

SOLID EXPLOSIVE COMPOSITION

This invention relates to a solid explosive composition of the kind comprising a water-in-oil emulsion when formulated at elevated temperature and which becomes solid on cooling to ambient temperature. The emulsion comprises a discontinuous oxidiser phase dispersed throughout a continuous fuel phase which is substantially immiscible with the discontinuous phase.

Commercially available emulsion explosive compositions generally comprise an external or continuous organic fuel phase in which discrete droplets of an aqueous solution of an oxygen-supplying salt are dispersed as an internal or discontinuous phase. Such compositions are conventionally described as water-in-oil emulsion explosive compositions, and examples thereof have been described, inter alia, in U.S. Pat. Nos. 3,447,978, 3,674,578, 3,770,522, 4,104,092, 4,111,727, 4,149,916, 4,149,917 and 4,490,194.

Emulsion explosive compositions may be manufactured for a variety of blasting applications and may vary in form from a cap-sensitive composition detonable in small diameter charges to a cap-insensitive composition intended for detonation only by boostering in large diameter charges. continuous phase. In addition, the emulsifier is believed to exist as a molecular coating layer on the surface of the droplets thereby to reduce incipient breakdown of the emulsion by inhibiting coalescence and agglomeration of the droplets.

For certain applications the water content of the oxidiser phase of the emulsion explosive may be completely eliminated or at least reduced to a low level—for example, to less than 5% by weight of the total emulsion composition. Such compositions are conventionally referred to as melt-in-oil or melt-in-fuel emulsion explosives and have been described, inter alia, in U.S. Pat. No. 4,248,644.

The conventional water-in-oil emulsion explosives such as those used for rock blasting are formulated to remain in soft condition even when cooled to ambient temperatures in order that they may be pumped, poured or extruded into boreholes or containers. In these explosives the droplets of the discontinuous phase remain as discrete droplets during cooling but become supersaturated solutions during cooling and, after cooling, remain in a supercooled condition without much crystallisation of the oxidiser salt.

In U.S. Pat. No. 4,548,659 and European Patent Publication No. 152060 solidified melt-in-fuel emulsion explosive compositions are described. These compositions are advantageous as cheaper, castable explosive compositions to replace relatively expensive cast self-explosives such as TNT, or pentolite in the manufacture of explosive boosters, shaped charges and solid propellant. The emulsions for these compositions are prepared at elevated temperatures but, on cooling, the oxidiser salt in the droplets of the continuous phase eventually crystallise, after initially supercooling, the crystallisation being attributable to the use of special surfactants which gave unstable emulsions. The melt component of these compositions generally have melting points in excess of 130° C. and when melts having lower melting points are used the rate and degree of solidification is variable and solidification may not occur in reasonable time. Moreover in the previous solidified melt-in-fuel compositions there is a high degree of rupture of the continuous fuel phase with consequent linking of a large proportion of the crystallised droplets to form a solid matrix (which has been termed a microknit structure). Such linking together of the crystals from adjacent droplets is not altogether beneficial and in some cases it is advantageous to reduce or eliminate rupture of the fuel barrier between the crystallised droplets i.e. to obtain a solid melt-in-fuel emulsion wherein the fuel phase continuity is preserved to some extent rather than microknit structure wherein the fuel phase continuity is destroyed.

It is an object of this invention to provide explosive compositions having low water content which are melt-in-fuel emulsions when formulated and which, on cooling, reliably solidify faster with a reduced degree of rupture of the fuel barrier between the crystallised emulsion droplets.

We have found that, if a particulate nucleating agent is mixed with the emulsion, on cooling the crystallisation is accelerated and a significant proportion of the droplets remain totally encapulated in the fluid phase. Low melting oxidiser melts can be used, and solid products can be obtained from certain compositions which, in the absence of the nucleating agent, did not solidify in a reasonable time.

In accordance with this invention a solid explosive composition comprises a melt-in-fuel emulsion when prepared at elevated temperature, which composition becomes solid on cooling to ambient temperature, said emulsion comprising a continuous phase containing water-immiscible fuel and emulsifier and a discontinuous phase containing oxidiser salt, the said composition containing less than 5% by weight of water and containing at least one particulate material effective as a nucleating agent to reduce supercooling of the discontinuous phase and to accelerate crystallisation of the oxidiser salt.

The invention further comprises a process for producing a solid explosive composition which comprises emulsifying at elevated temperature a liquid oxidiser salt component containing less than 5% water by weight of the composition and a water immiscible liquid fuel component in the presence of an emulsifying agent to form a melt-in-fuel emulsion in which the oxidiser salt is in the discontinuous phase and the fuel is in the continuous phase, cooling said emulsion and allowing the oxidiser salt to crystallise in admixture with particulate material effective as a nucleating agent whereby crystallisation of the oxidiser salt is accelerated.

Since the emulsion droplets are very small, typically $10^{10}$–$10^{12}$ droplets being in 1 c.c. of emulsion, the particulate material is preferably in the form of finely divided colloidal solid particles in order to ensure uniform nucleation of the droplets. The solid particles must be insoluble in the emulsion and may be mixed with the prepared emulsion or with any of the separate ingredients before the emulsion is prepared. Thus colloidal silica or titania or an aqueous suspension thereof may be mixed with a preformed emulsion, or particles of aluminium salt may be premixed with the molten oxidiser salt before the emulsion is prepared. Alternatively, the solid colloidal particles may be formed in situ in the emulsion, for example by the hydrolysis of a hydrolysable salt or compound such as an aluminium salt, or by a double decomposition reaction between soluble salts which form an insoluble salt by ion exchange, such as the reaction of a melt-soluble barium or calcium salt and a sulphate such as aluminium sulphate. One of the reactants may be incorporated in the emulsion, the other being mixed subsequently with the emulsion. Formation of the colloidal particles in situ by double decomposition provides a means of accurately controlling the time of setting of the droplets of the oxidiser salt in the emulsion, since one soluble salt may be intimately mixed in a stable melt-in-fuel emulsion which may be poured or extruded into a container and the precipitating salt may be subsequently mixed with the emulsion to cause setting of the emulsified droplets with little rupture of the fuel barrier between the droplets.

The oxidiser salt of the discontinuous phase suitably comprises any oxidiser salt capable of releasing oxygen in an explosive environment in an amount and at a rate sufficient to confer acceptable explosive characteristics on the emulsion composition. Oxidiser salts conventionally employed in the production of emulsion explosive compositions, and suitable for inclusion in the compositions of the present invention, include ammonium salts and salts of the alkali—and alkaline-earth metals—such as the nitrate, chlorate and perchlorate salts, organic nitrates and perchlorates such as amine or polyamine nitrates and perchlorates, hydrazine nitrate, urea perchlorate, guanidine nitrate, guanidine perchlorate, triaminoguanidine nitrate, triaminoguanidine perchlorate and mixtures thereof.

Ammonium nitrate is preferably employed as a primary oxidiser salt comprising at least 50% by weight of the oxygen-supplying salt component, supplemented, if desired, by a minor (not exceeding 50% by weight) amount of a secondary oxidiser component such as calcium nitrate or sodium nitrate. Advantageously the oxidiser component includes a substance which forms an eutectic melt when heated together with ammonium nitrate. Suitable substances include inorganic oxidiser salts such as the nitrates of lead, silver, sodium and calcium, and organic compounds, such as mono- and poly-hydroxylic compounds including methanol, ethylene glycol, glycerol, mannitol, sorbitol, pentaerythritol, carbohydrates such as glucose, sucrose, fructose and maltose, dimethyl sulphoxide, aliphatic carboxylic acids and their derivatives such as formic acid, formamide, and acetamide and organo-nitrogen compounds, such as urea, methylamine nitrate and hexamethylene tetramine, and mixtures thereof.

The explosive composition may optionally comprise a solid oxidiser component, such as solid ammonium nitrate conveniently in the form of prills. Typically, the discontinuous phase may constitute from about 20 to about 97%, more usually from 30 to 95%, and preferably from 70 to 95% by weight of the total emulsion explosive composition. The discontinuous phase may be entirely devoid of water, in the case of a melt emulsion, or may comprise relatively minor amounts of water, up to 5% by weight of the total composition.

The continuous phase of the emulsion explosive composition in accordance with the invention serves as a fuel for the explosive composition and should be substantially insoluble in the component(s) of the discontinuous phase with which it should be capable of forming an emulsion in the presence of an effective amount of an appropriate emulsifying agent. Ease of emulsification depends, inter alia, on the viscosity of the continuous phase, and accordingly the continuous phase should be capable of existing initially in a sufficiently fluid state, if necessary in response to appropriate temperature adjustment, to permit emulsification to proceed.

Suitable fuels which are capable of existing in the liquid state at convenient emulsion formulation temperatures include saturated and unsaturated aliphatic and aromatic hydrocarbons, and mixtures thereof. Preferred fuels include for example refined (white) mineral oil, diesel oil, paraffin oil, isoparaffinic oil, petroleum distillates, benzene, toluene, dinitrotoluene, trinitrotoluene, styrene, xylenes, waxes, for example paraffin wax, microcrystalline wax, beeswax, woolwax, slackwax, and carnauba wax, aromatic nitro compounds and nitrate, esters for example isooctylnitrate, and mixtures thereof. The continuous phase preferably comprises one or more waxes to control the rheology of the system. Suitable waxes have melting temperatures of at least 30° C. and are readily compatible with the formed emulsion. A preferred wax has a melting temperature in a range from about 40° C. to 75° C.

The continuous phase may, if desired, include a polymeric material for example, polyisobutene, polyethylene or ethylene/vinyl acetate copolymer, or a polymer precursor.

Generally, the continuous phase (including wax(es), if present) constitutes from 1 to 25, preferably from 2 to 20%, and particularly preferably from 3 to 12% by weight of the total explosive composition. Higher proportions, may be tolerated, if desired.

Formulation of a stable emulsion is generally effected in the presence of an emulsifier capable of promoting a permanent dispersion of the discontinuous phase component(s) in the continuous phase medium.

The emulsifiers used are generally strongly lipophilic, i.e. they exhibit a high affinity for the oily or organic medium of the continuous phase.

Many suitable emulsifiers are described in detail in the literature and include, for example, sorbitan esters, such as sorbitan sesquioleate, sorbitan monooleate, sorbitan monopalmitate, sorbitan stearates and isostearates, for example sorbitan monostearate and sorbitan tristearate; glycerol oleates and isostearates, the mono and diglycerides of fat-forming fatty acids; soyabean lecithin; derivatives of lanolin, such as esters of lanolin fatty acids; mixtures of higher molecular weight fatty alcohols and wax esters; ethoxylated fatty ethers such as polyoxyethylene(4)lauryl ether, polyoxyethylene(2)oleyl ether, and polyoxyethylene(2)stearyl ether; polyoxyalkylene oleyl laurate; substituted oxazolines, such as 2-oleyl-4,4'-bis(hydroxymethyl)-2-oxazoline, and 4,4'-bis(hydroxymethyl)-2-heptadecenyl oxazoline; and polymeric emulsifiers such as alkyds, ethylene oxide/propylene oxide copolymers and hydrophobe/hydrophil block copolymers. Suitable mixtures of such conventional emulsifiers may also be selected for use. Additionally a portion of the emulsifier may be an anionic emulsifier, for example alkyl aryl sulphonate, or a cationic emulsifier, for example a fatty amine or a salt thereof, which may be added to improve emulsification.

Preferably the emulsifier is present in an amount in the range from 0.5 to 4% by weight of the explosive composition.

The composition may, if desired, include an emulsion stabiliser which may advantageously be a polymeric surfactant for example a condensate of polyisobutenyl succinic anhydride or poly-12-hydroxy stearic acid with ethanolamine, diethanolamine, glycine, amine or polyamine, for example diethylene triamine. Surfactants of this type containing hydroxyl groups may be further reacted with phosphoric or sulphuric acid to form advantageous anionic stabilisers. The stabiliser may also advantageously be a block copolymer such as may be formed by reacting polyisobutenyl succinic anhydride or poly-12-hydroxy stearic acid with polyethylene glycol or a copolymer of methacrylic acid and octadecylmethacrylate.

If desired, supplementary fuel components may be included in the composition. Typical supplementary fuel components suitable for incorporation into the discontinuous phase include soluble carbohydrate materials, such as glucose, sucrose, fructose, maltose and molasses, lower glycols, formamide, urea, methylamine nitrate, hexamethylene tetramide, hexamethylene tetramine nitrate, and other organic nitrates.

Supplementary fuel components which may be incorporated into the continuous phase include fatty acids, higher alcohols, vegetable oils, aliphatic and aromatic nitro organic compounds such as dinitrotoluene and nitrate esters.

Supplementary fuel components which may be included with the emulsion in the explosive composition include solid particulate materials such as coal, graphite, carbon, sulphur, aluminium, magnesium and mixtures thereof.

The amount of supplementary fuel component(s) employed may be varied in accordance with the required characteristics of the compositions, but, in general, will be in the range of from 0 to 30%, preferably from 5 to 25%, by weight of the total composition.

Thickening and or cross-linking agents may be included in the compositions, if desired—generally in small amounts up to the order of 10, and preferably from 1 to 5%, by weight of the total explosive composition. Typical thickening agents include natural gums, such as guar gum or derivatives thereof, and synthetic polymers, particularly those derived from acrylamide.

Minor amounts of non-volatile, water insoluble polymeric or elastomeric materials, such as natural rubber, synthetic rubber and polyisobutylene may be incorporated into the continuous phase. Suitable polymeric additives include butadiene-styrene, isoprene-isobutylene, or isobutylene-ethylene copolymers. Terpolymers thereof may also be employed to modify the continuous phase, and in particular to improve the retention of occluded gases in the compositions.

The emulsion explosive compositions of the present invention may, if desired, comprise a discontinuous gaseous component to reduce their density (to less than 1.5, and preferably to from about 0.8 to about 1.4 gm/cc) and enhance their sensitivity. The gaseous component, usually air, may be incorporated into the compositions of the present invention as fine gas bubbles dispersed throughout the composition, hollow particles which are often referred to as micro-balloons or microspheres, porous particles, or mixtures thereof. A discontinuous phase of fine gas bubbles may be incorporated into the compositions of the present invention by mechanical agitation, injection or bubbling the gas through the composition, or by chemical generation of the gas in situ. Suitable chemicals for the in situ generation of gas bubbles include peroxides such as hydrogen peroxide, nitrites such as sodium nitrite, nitrosoamines such as N,N'-dinitrosopentamethylenetetramine, alkali metal borohydrides such as sodium borohydride, and carbonates such as sodium carbonate. Preferred chemicals for the in situ generation of gas bubbles are nitrous acid and its salts which decompose under conditions of acid pH to produce gas bubbles. Thiourea may be used to accelerate the decomposition of a nitrite gassing agent. Suitable hollow particles include small hollow microspheres of glass and resinous materials, such as phenol-formaldehyde and urea-formaldehyde. Suitable porous materials include expanded minerals, such as perlite. The gas component is usually added during cooling such that the prepared emulsion comprises from about 0.05 to 50% by volume of gas at ambient temperature and pressure. An explosive composition according to the present invention may be prepared by conventional emulsification techniques. Thus, the oxygen-supplying component may be melted or dissolved preferably at a temperature in the range of from 60° to 130° C., and a mixture, preferably a solution, of the emulsifying agent and the fuel of the continuous phase is separately prepared, preferably at the same temperature as the oxygen supplying component. The aqueous phase is then added to the organic phase with rapid mixing to produce the emulsion explosive composition, mixing being continued until the formation is uniform. Optional solid and or gaseous components may then be introduced with further agitation until a homogeneous emulsion is obtained.

An emulsion explosive composition according to the invention may be used as such, or may be packaged, cast or shaped into charges of appropriate dimensions.

The invention is illustrated by reference to the following Examples in which all parts and percentages are expressed on a weight basis unless otherwise stated.

EXAMPLE 1

A melt-in-oil emulsion explosive composition was prepared, the composition consisting of the following:

| | parts |
|---|---|
| Melt phase | |
| Ammonium nitrate | 50 |
| Ethylene diamine dinitrate | 25 |
| Lithium nitrate | 20 |
| Oil phase | |
| Mineral oil | 3 |
| Sorbitan sesquioleate | 2 |

The emulsion was prepared by slowly adding the molten oxidiser melt at 105° C. to the oil phase at 95° C. in a high shear planetary emulsifier mixer. The mixture was vigorously stirred to yield a melt-in-fuel emulsion having an average droplet size of about 1 micron. A first batch of this emulsion was allowed to cool and was stored at ambient temperature (5°–10° C.) for one week, after which the emulsion remained fluid and translucent.

3 parts of a 40% aqueous dispersion of $7\times10^{-9}$ meter average diameter colloidal silica (nucleating agent) was added to a second batch of freshly prepared emulsion, which was vigorously stirred to distribute the silica throughout the emulsion. On storing for 3 days at 5°–10° C. patches of crystallised emulsion were evident and after one week the emulsion had solidified. A high proportion of the emulsion droplets remained encapsulated in the continuous oil phase.

EXAMPLE 2

A melt-in-oil emulsion explosive composition consisting of the following ingredients was prepared.

| | parts |
|---|---|
| Melt phase | |
| Ammonium nitrate | 50 |
| Ethylene diamine dinitrate | 25 |
| Lithium nitrate | 10 |
| Sodium nitrate | 10 |

-continued

| | parts |
|---|---|
| Oil phase | |
| Mineral oil | 3 |
| Sorbitan mono-oleate | 2 |

The emulsion was prepared as described in Example 1. 3 parts of finely divided silica (Aerosil 200) were added to the emulsion and the mixture was vigorously stirred.

On cooling the emulsion set to a solid microcrystalline mass in less than one day. A high proportion of the emulsion droplets remained encapsulated in the continuous oil phase.

EXAMPLE 3

A melt-in-oil emulsion explosive composition consisting of the following ingredients was prepared.

| | parts |
|---|---|
| Melt phase | |
| Ammonium nitrate | 50 |
| Ethylene diamine dinitrate | 25 |
| Lithium nitrate | 10 |
| Sodium nitrate | 7.5 |
| Barium nitrate | 2.5 |
| Oil phase | |
| Mineral oil | 3 |
| Sorbitan sesquioleate | 2 |

The emulsion was prepared as described in Example 1, the average droplets size being about 1 micron diameter. 5 parts of a 1:1 w/w aqueous ammonium sulphate solution was added to the emulsion at 90° C. with vigorous stirring. The emulsion was allowed to cool and stored at ambient temperature (5°–10° C.). After 1 day crystalline regions developed within the emulsion and solidification was complete within one week, a high proportion of the droplets remaining totally encapulated in the oil phase. A sample of the solidified emulsion was melted on a microscope hot stage. As the melting point of the solid salt phase was reached the individual microcells separated from the main body of the emulsion and melted. After melting was complete a large number of particles of the nucleating species in the molten phase were evident from light scattering.

A second sample of the emulsion without addition of ammonium sulphate showed no crystalline region after storage for one week at ambient temperature.

EXAMPLE 4

A melt-in-oil emulsion was prepared as described in Example 1 consisting of the following ingredients:

| | parts |
|---|---|
| Melt phase | |
| Ammonium nitrate | 55.0 |
| Guanidine nitrate | 15.0 |
| Lithium nitrate | 5.0 |
| Sodium nitrate | 10.0 |
| Potassium nitrate | 5.0 |
| Barium nitrate | 5.0 |
| Oil phase | |
| Mineral oil | 1.0 |
| Microcrystalline wax | 1.0 |
| Paraffin wax | 1.0 |
| Sorbitan mono-oleate | 2.0 |

A second melt-in-oil emulsion was proposed as described in Example 1 consisting of the following ingredients:

| | |
|---|---|
| Melt phase | |
| Ammonium nitrate | 55.0 |
| Guanidine nitrate | 15.0 |
| Lithium nitrate | 5.0 |
| Sodium nitrate | 10.0 |
| Ammonium perchlorate | 7.5 |
| Ammonium sulphate | 2.5 |
| Oil phase | |
| Mineral oil | 1.0 |
| Microcrystalline wax | 1.0 |
| Paraffin wax | 1.0 |
| Sorbitan mono-oleate | 2.0 |

The two emulsions were mixed together at 85° C. under high shear conditions, allowed to cool and then stored at ambient. After one day crystallization was evident in the emulsion and was complete within one week. Samples of the two emulsions stored separately were still uncrystallized after one week.

EXAMPLE 5

A melt-in-oil base emulsion explosive composition consisting of the following ingredients was prepared.

| | parts |
|---|---|
| Melt phase | |
| Ammonium nitrate | 49.0 |
| Sodium nitrate | 5.0 |
| Potassium nitrate | 5.0 |
| Lithium nitrate | 10.0 |
| Ethylene diamine dinitrate | 25.0 |
| Oil phase | |
| Mineral oil | 4.0 |
| Sorbitan sesquioleate | 2.0 |

The emulsion was prepared as described in Example 1, the droplet size (number average) being about 1.5 microns.

(a) 100 g. of the base emulsion was sealed in a glass bottle. After 5 days storage at 0°–10° C. there was no crystallisation and the sample remained fluid and translucent.

(b) 100 g. of the base emulsion were mixed by continuous stirring with 1 g. of tetra(n-butyl)ortho-titanate, a compound which decomposed in the emulsion to produce colloidal titania. After 10 seconds the sample had solidified to a fine grained powder.

(c) 100 g. of the base emulsion were mixed with 2 g. of tetramethyl silicate, a compound which decomposed in the emulsion to produce colloidal silica. After 18 hrs. the sample had set to a fine grained solid.

(d) 100 g. of the base emulsion were mixed with 1 g. of tetramethyl ortho-silicate and 1 g. of water. After 18 hrs. the sample had set to a fine grained solid.

EXAMPLE 6

A melt-in-oil base emulsion explosive composition consisting of the following ingredients was prepared as described in Example 1.

| | parts |
|---|---|
| Melt phase | |
| Ammonium nitrate | 49.0 |
| Sodium nitrate | 5.0 |

-continued

| | parts |
|---|---|
| Potassium nitrate | 5.0 |
| Lithium nitrate | 10.0 |
| Ethylene diamine dinitrate | 25.0 |
| Oil phase | |
| Mineral oil | 3.5 |
| Polyisobutylene | 0.5 |
| Glycerol mono-oleate | 2.0 |

60 parts of the base emulsion were mixed with 12 parts of atomised aluminium (particle size 0.25 mm.—dust), 26 parts of ammonium perchlorate and 2 parts of tetramethyl silicate. After 24 hrs. the composition had set solid.

EXAMPLE 7

A melt-in-oil base emulsion explosive composition consisting of the following ingredients was prepared as described in Example 1.

| | parts |
|---|---|
| Melt phase | |
| Ammonium nitrate | 60.0 |
| Sodium perchlorate | 5.0 |
| Lithium nitrate | 15.0 |
| Urea | 5.0 |
| Guanidine nitrate | 10.0 |
| Oil phase | |
| Mineral oil | 3.5 |
| Sorbitan mono-oleate | 1.0 |
| Poly(isobutenyl) succinic anhydride/diethylene triamine (1:1 mole ratio) condensate | 0.5 |

(a) 98 parts of the base emulsion were mixed with 2 parts of tetramethyl silicate. After 24 hrs. the composition had set solid.

(b) 96 parts of the base emulsion were mixed with 2 parts of glass micro-balloons (type C15/250) and 2 parts of tetramethyl silicate. After 24 hrs. the mixture had set solid.

We claim:

1. A solid explosive composition comprising a water-in-oil emulsion when prepared at elevated temperature, which composition becomes solid on cooling to ambient temperature, said emulsion comprising a continuous phase containing water-immiscible fuel and emulsifier and a discontinuous phase containing oxidiser salt, the said composition containing less than 5% by weight of water and containing at least one particulate material effective as a nucleating agent to reduce supercooling of the discontinuous phase and accelerate crystallisation of the oxidiser salt.

2. A composition as claimed in claim 1 wherein the particulate material comprises finely divided coloidal solid particles.

3. A composition as claimed in claim 2 wherein the particulate material is selected from the group consisting of colloidal silica, colloidal titania and salts of aluminium, barium and calcium.

4. A composition as claimed in claim 1 wherein the oxidiser salt is selected from the group consisting of nitrates and perchlorates of ammonia; nitrates, chlorates and perchlorates of alkali and alkaline earth metals; nitrates and perchlorates of amines and polyamines; hydrazine nitrate, urea perchlorate, guanidine nitrate, guanidine perchlorate, triaminoguanidine nitrate triaminoguanidine perchlorate and mixtures of any two or more thereof.

5. A composition as claimed in claim 4 wherein the oxidiser salt component comprises a mixture of ammonium nitrate, and a substance which forms an eutectic melt when heated together with ammonium nitrate.

6. A composition as claimed in claim 5 wherein the substance included to form the eutectic melt is selected from the group consisting of nitrates of lead, silver, sodium and calcium; methanol, ethylene glycol, glycerol, mannitol, sorbitol, pentaerythritol, glucose, sucrose, fructose, maltose, dimethyl sulphoxide, formic acid, formadide, acetamide, urea, methylamine nitrate, hexamethylene tetramine and a mixture of any two or more thereof.

7. A composition as claimed in claim 1 wherein the continuous phase is selected from the group consisting of saturated and unsaturated aliphatic and aromatic hydrocarbons and polymeric materials.

8. A composition as claimed in claim 7 wherein the continuous phase is selected from the group consisting of refined mineral oil, diesel oil, paraffin oil, isoparaffinic oil, petroleum distillate, benzene, toluene, dinitrotoluene, trinitrotoluene, styrene, xylene, paraffin wax, microcrystalline wax, beeswax, woolwax, slackwax, carnauba wax, and isooctylnitrate.

9. A composition as claimed in claim 1 wherein the continuous phase constitutes from 3 to 12% by weight of the total composition.

10. A composition as claimed in claim 1 wherein the emulsifier is selected from the group consisting of sorbitan esters, glycerol oleates, glycerol isostearates, mono- and di-glycerides of fat-forming fatty acids, soya bean lecithin, esters of lanolin fatty acid, mixtures of higher molecular weight fatty alcohols and wax esters, ethoxylated fatty ethers, polyoxyalkylene oleyl laurates, substituted oxazolines and polymeric emulsifiers.

11. A process for producing a solid explosive composition comprising emulsifying at elevated temperature a liquid oxidiser salt component containing less than 5% water by weight of the composition and a water immiscible liquid fuel component in the presence of an emulsifying agent to form a melt-in-fuel emulsion in which the oxidiser salt is in the discontinuous phase and the fuel is in the continuous phase, cooling said emulsion and allowing the oxidiser salt to crysallise in admixture with particulate material effective as a nucleating agent whereby crystallisation of the oxidiser salt is accelerated.

12. A process as claimed in claim 11 wherein the said components are emulsified at a temperature less than 130° C.

13. A process as claimed in claim 11 wherein particulate nucleating agent in the form of colloidal particles is formed in situ in the emulsion.

14. A process as claimed in claim 13 wherein the colloidal particles are formed by a process selected from the group consisting of the hydrolysis of a hydrolysable substance and the double decomposition reaction between soluble salts which form an insoluble salt by ion exchange.

15. A process as claimed in claim 14 wherein the particulate nucleating agent is formed in situ by the reaction of a sulphate with a salt selected from the group consisting of melt-soluble barium and calcium salts.

* * * * *